US009702615B1

(12) United States Patent
Chartrand et al.

(10) Patent No.: US 9,702,615 B1
(45) Date of Patent: Jul. 11, 2017

(54) INTERNAL CABINET SUPPORT STRUCTURE

(71) Applicant: Electrolux Home Products, Inc., Charlotte, NC (US)

(72) Inventors: Scott Chartrand, Charlotte, NC (US); Jeremy Bannister, Belton, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 14/994,209

(22) Filed: Jan. 13, 2016

(51) Int. Cl.
*F25D 23/06* (2006.01)
*A47B 96/14* (2006.01)

(52) U.S. Cl.
CPC ..... *F25D 23/067* (2013.01); *A47B 96/14* (2013.01); *F25D 23/062* (2013.01); *F25D 23/066* (2013.01)

(58) Field of Classification Search
CPC ..... F25D 23/062; F25D 2400/04; F25D 2400/06; F25D 23/065; F25D 23/066; F25D 23/063; F25D 23/10; F25D 23/067; F25D 23/069; A47B 96/14
USPC .... 312/406.2, 406, 407, 257.1, 401; 62/440, 62/441, 447
See application file for complete search history.

(56) References Cited

U.S. PATENT DOCUMENTS 2,675,687 A * 4/1954 Philipp ..... F25B 39/02 220/592.05
3,520,581 A * 7/1970 Borghi ..... F25D 23/064 312/236
4,558,503 A 12/1985 Wilson
4,606,112 A 8/1986 Jenkins et al.
4,632,470 A * 12/1986 Jenkins ..... F25D 23/062 29/525.12
4,822,117 A * 4/1989 Boston, Jr. ..... F25D 23/062 29/455.1
4,900,108 A * 2/1990 Tischer ..... A47B 47/0008 312/265.3
5,033,182 A 7/1991 Winterheimer et al.
5,187,837 A 2/1993 Gunderson et al.
5,368,381 A * 11/1994 Mandel ..... F25D 23/062 312/406.2
5,584,551 A 12/1996 Jenkins
5,720,536 A * 2/1998 Jenkins ..... F25D 23/085 312/401
5,897,181 A 4/1999 Avendano et al.
(Continued)

*Primary Examiner* — Daniel J Troy
*Assistant Examiner* — Hiwot Tefera
(74) *Attorney, Agent, or Firm* — Pearne & Gordon, LLP

(57) ABSTRACT

A cabinet includes a shell having a top wall and first and second side walls extending substantially perpendicular from the top wall. The cabinet further includes a first compartment liner defining a first storage compartment. The cabinet further includes upper and lower support members provided on opposite sides of the first compartment liner and extending substantially parallel to the top wall. The cabinet further includes a first vertical support bar secured to the upper and lower support members that extends substantially parallel to the first and second side walls and between the first compartment liner and the first side wall. The cabinet further includes a second vertical support bar secured to the upper and lower support members that extends substantially parallel to the first and second side walls and between the first compartment liner and the second side wall. The first and second vertical support bars have an L-shaped cross-section.

14 Claims, 10 Drawing Sheets

(56) References Cited

U.S. PATENT DOCUMENTS

| | | | | |
|---|---|---|---|---|
| 5,899,546 | A | 5/1999 | Avendano et al. | |
| 5,992,960 | A | 11/1999 | Wolanin | |
| 6,036,293 | A * | 3/2000 | Anell | F25D 23/063 312/257.1 |
| 6,036,294 | A | 3/2000 | Banicevic et al. | |
| 6,238,029 | B1 * | 5/2001 | Marzec | H02B 1/30 211/26 |
| 6,773,082 | B2 | 8/2004 | Lee | |
| 7,014,283 | B2 * | 3/2006 | Grace | F25D 23/062 312/406 |
| 7,055,920 | B2 * | 6/2006 | Leistner | B60N 3/104 220/592.06 |
| 7,108,341 | B2 | 9/2006 | Myers et al. | |
| 7,182,417 | B2 | 2/2007 | Taylor et al. | |
| 7,194,792 | B2 | 3/2007 | Grace et al. | |
| 7,293,848 | B2 | 11/2007 | Myers et al. | |
| 7,517,031 | B2 | 4/2009 | Laible | |
| 7,748,805 | B2 | 7/2010 | Lucas et al. | |
| 8,136,367 | B2 | 3/2012 | Froelicher et al. | |
| 8,632,272 | B2 * | 1/2014 | Wojtowicz | A47B 96/145 211/182 |
| 8,931,300 | B2 * | 1/2015 | Smith | F25D 23/065 62/443 |
| 2009/0151375 | A1 | 6/2009 | Tarr et al. | |
| 2012/0031129 | A9 | 2/2012 | Tarr et al. | |

* cited by examiner

INTERNAL CABINET SUPPORT STRUCTURE

TECHNICAL FIELD

The present disclosure relates to a cabinet and more particularly, an internal, rigid support structure for the cabinet.

BACKGROUND

A cabinet can include an exterior shell and one or more compartment liners provided within the shell that define a storage compartment. For example, a refrigerator cabinet can include a first compartment liner defining a freezer storage compartment and a second compartment liner defining a fresh food storage compartment. A cabinet can further include one or more doors providing selective access to the storage compartments. Loads on the structure of the cabinet such as, for example, the door, shell, or compartment liners can cause the structure to deflect, bend, twist, or otherwise move. Excessive movement can cause some structure to become misaligned and can affect the appearance and/or function of the structure.

SUMMARY

The following presents a simplified summary of the disclosure in order to provide a basic understanding of some example aspects described in the detailed description.

In accordance with a first aspect, a cabinet comprises a shell having a top wall and first and second side walls extending substantially perpendicular from the top wall. The cabinet further comprises a first compartment liner provided within the shell, the first compartment liner defining a first storage compartment. The cabinet further comprises an upper support member and lower support member provided on opposite sides of the first compartment liner, the upper and lower support members extending substantially parallel to the top wall. The cabinet further comprises a first vertical support bar secured to the upper and lower support members, the first vertical support bar extending substantially parallel to the first and second side walls and between the first compartment liner and the first side wall. The cabinet further comprises a second vertical support bar secured to the upper and lower support members, the second vertical support bar extending substantially parallel to the first and second side walls and between the first compartment liner and the second side wall. The first and second vertical support bars have an L-shaped cross-section along a plane that is substantially perpendicular to the first and second side walls.

In one example of the first aspect, the first vertical support bar comprises first and second members that longitudinally extend substantially parallel to the first and second side walls and are joined together along a longitudinal side thereof to form a right angle.

In another example of the first aspect, the first vertical support bar is in direct contact with the first side wall and the second vertical support bar is in direct contact with the second side wall.

In yet another example of the first aspect, the shell comprises a first side flange portion that extends substantially perpendicular from the first side wall and a second side flange portion that extends substantially perpendicular from the second side wall. The first vertical support bar is in direct contact with the first side flange portion and the second vertical support bar is in direct contact with the second side flange portion.

In still yet another example of the first aspect, the upper support member comprises first and second end portions that each comprise a shoulder. The shoulder of the first end portion rests upon the first vertical support bar and the shoulder of the second end portion rests upon the second vertical support bar.

In another example of the first aspect, the first and second vertical support bars are secured to the upper support member with a foam that holds the first and second vertical support bars against the upper support member.

In yet another example of the first aspect, the cabinet comprises a second compartment liner provided within the shell, the second compartment liner defining a second storage compartment. The upper support member extends between the first compartment liner and the second compartment liner. In one example, the upper support member comprises first and second end portions that extend parallel to the first and second side walls. The first end portion extends between the first side wall and the first and second compartment liners and the second end portion extends between the second side wall and the first and second compartment liners. In another example, the first and second end portions of the upper support member are in direct contact with the first compartment liner and the second compartment liner. In yet another example, the first end portion of the upper support member is in direct contact with the first side wall and the second end portion of the upper support member is in direct contact with the second side wall.

In still yet another example of the first aspect, the cabinet comprises a first base member and a second base member positioned below the first compartment liner, the first base member comprising a first vertical channel for receiving the first vertical support bar and the second base member comprising a second vertical channel for receiving the second vertical support bar. In one example, the first vertical channel is defined by a front wall of the first base member and a side wall of the first base member. The first base member comprises a vertical opening between the front wall of the first base member and the side wall of the first base member. In another example, the first vertical support bar is received within the first vertical channel such that the first vertical support bar is in direct contact with an interior surface of the front wall of the first base member and an exterior surface of the side wall of the first base member. The first vertical support bar extends through the vertical opening.

In another example of the first aspect, the cabinet comprises a tapping plate. The tapping plate is in direct contact with the top wall, a top flange portion extending substantially perpendicular from the top wall, and a side flange portion extending substantially perpendicular from one of the first and second side walls. In one example, the tapping plate is secured to the shell with a foam that holds the tapping plate against the shell. In another example, the tapping plate is spaced from the one of the first and second side walls.

In yet another example of the first aspect, the cabinet comprises a door and upper and lower hinge members, the upper hinge member being attached to the upper support member and movably coupling the door to the upper support member, the lower hinge member being attached to the lower support member and movably coupling the door to the lower support member.

The first aspect can be provided alone or in combination with one or any combination of the examples of the first aspect discussed above.

In accordance with a second aspect, a cabinet comprises a shell having a top wall and first and second side walls extending substantially perpendicular from the top wall. The cabinet further comprises a first compartment liner provided within the shell, the first compartment liner defining a first storage compartment. The cabinet further comprises a horizontal support member provided either below or above the first compartment liner, the horizontal support member extending substantially parallel to the top wall. The cabinet further comprises a first vertical support bar extending substantially parallel to the first and second side walls and between the first compartment liner and the first side wall. The first vertical support bar and the horizontal support member are secured together by gravity and a foam that hold the horizontal support member against the first vertical support bar. The cabinet further comprises a second vertical support bar extending substantially parallel to the first and second side walls and between the first compartment liner and the second side wall. The second vertical support bar and the horizontal support member are secured together by gravity and a foam that holds the horizontal support member against the second vertical support bar.

In accordance with a third aspect, a cabinet comprises a shell having a top wall and first and second side walls extending substantially perpendicular from the top wall. The cabinet further comprises a first compartment liner provided within the shell, the first compartment liner defining a first storage compartment. The cabinet further comprises a lower support member provided below the first compartment liner, the lower support member extending substantially parallel to the top wall. The cabinet further comprises a first base member and a second base member positioned below the first compartment liner. The cabinet further comprises a first vertical support bar extending substantially parallel to the first and second side walls and between the first compartment liner and the first side wall, wherein the first base member. The first vertical support bar, and the lower support member are secured to each other with a first threaded fastener extending through a first set of corresponding apertures in the first base member, the first vertical support bar, and the lower support member. The cabinet further comprises a second vertical support bar extending substantially parallel to the first and second side walls and between the first compartment liner and the second side wall. The second base member, the second vertical support bar, and the lower support member are secured to each other with another threaded fastener extending through a second set of corresponding apertures in the second base member, the second vertical support bar, and the lower support member.

DETAILED DESCRIPTION OF THE DRAWINGS

Embodiments of the invention are better understood when the following detailed description is read with reference to the accompanying drawings, in which.

DETAILED DESCRIPTION

Figure 1:
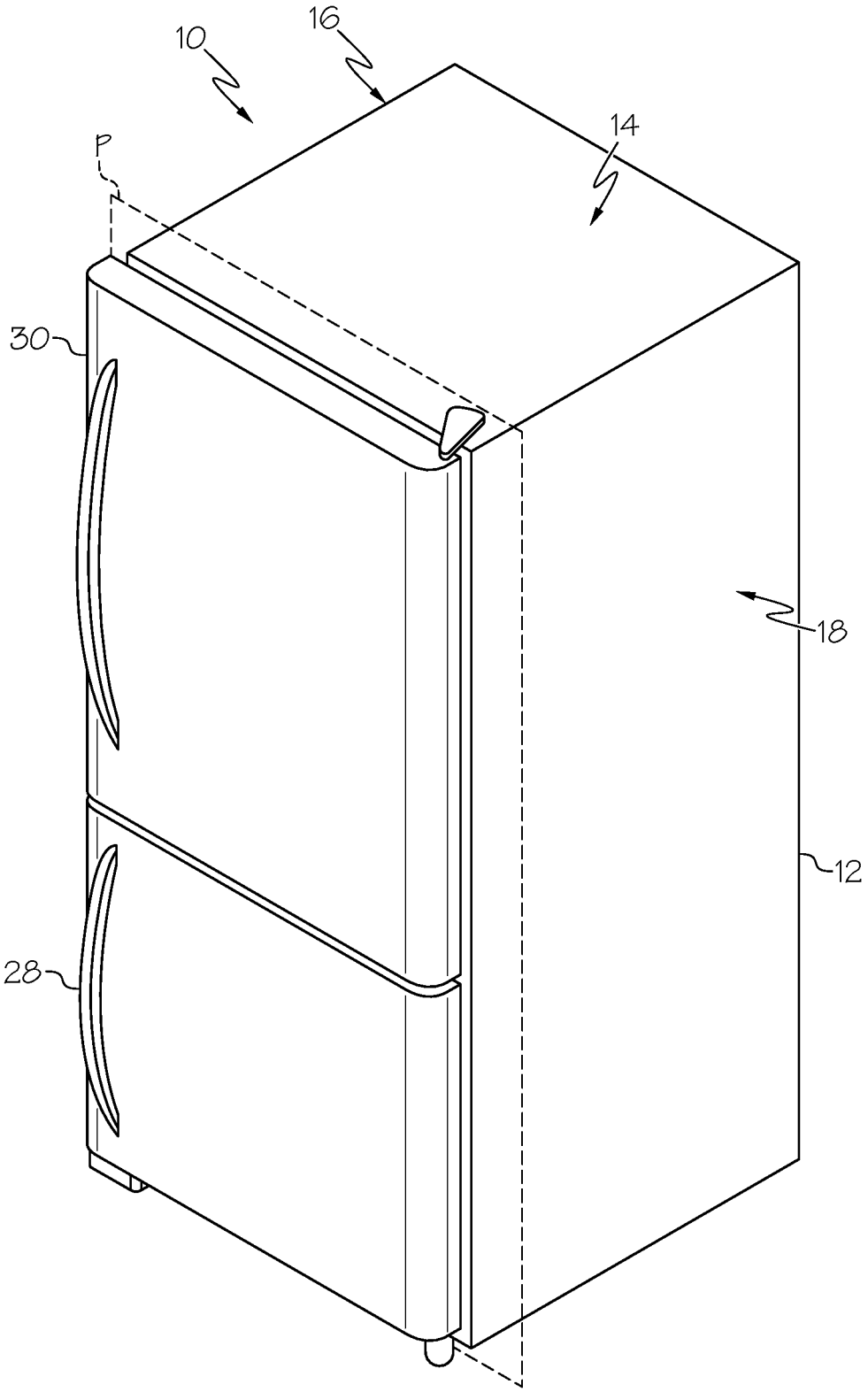
FIG. 1 is a perspective view of an example cabinet.

Examples incorporating one or more embodiments are described and illustrated in the drawings. These illustrated examples are not intended to be limiting. For example, one or more aspects of an embodiment may be utilized in other embodiments and even other types of devices, such as a bottom-mount refrigerator, a top-mount refrigerator, or a side-by-side refrigerator. It is to be noted that the phrases "substantially parallel" and "substantially perpendicular" as used herein respectively mean within 10 degrees or less of parallel and perpendicular, and more preferably, within 5 degrees or less of parallel and perpendicular.

Figure 2:
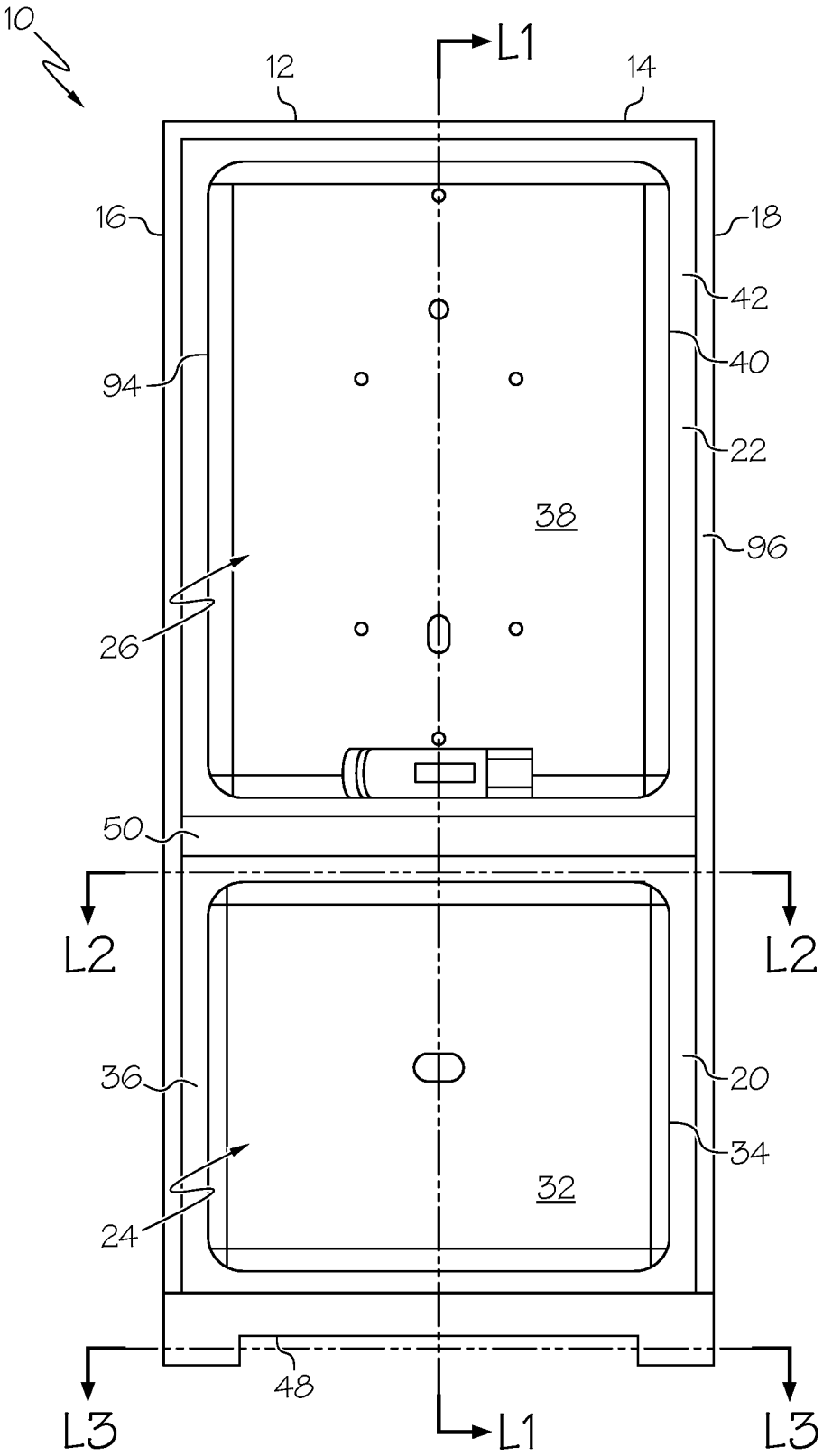
FIG. 2 is a front view of the example cabinet with doors of the cabinet removed.

Referring now to FIGS. 1 & 2, an example cabinet 10 is shown comprising a shell 12 having a top wall 14 and first and second side walls 16, 18 extending substantially perpendicular from the top wall 14. The cabinet 10 can comprise a first compartment liner 20 and a second compartment liner 22 provided within the shell 12, the first compartment liner 20 defining a first storage compartment 24 and the second compartment liner 22 defining a second storage compartment 26. The cabinet 10 can further comprise at least one door to provide selective access to one or both of the first and second storage compartments 24, 26. In the present example, the cabinet comprises a door 28 providing selective access to the first storage compartment 24 and a door 30 providing selective access to the second storage compartment 26.

The cabinet 10 in the present example is an appliance and, more specifically, a refrigerator with a fresh-food compartment with a bottom-mounted freezer compartment, the first and second storage compartments 24, 26 respectively being the freezer compartment and the fresh-food compartment. However, the cabinet 10 can be any cabinet-like structure that comprises a shell and one or more compartment liners within the shell and may be characterized as a drawer, a desk, a container, a chest, a safe, a cupboard or the like. The first and second storage compartments 24, 26 of the cabinet 10 may provide a particular type of environment for items stored therein and, for example, may be suitable for refrigeration, heating, sanitization, a vacuum, etc.

The first compartment liner 20 of the cabinet 10 can be positioned below the second compartment liner 22, as shown in the present example, or the first compartment liner 20 can be positioned above or to the side of the second compartment liner 22. The first and second compartment liners 20, 22 can be separate structures or they can be part of a single liner. In some embodiments, the cabinet 10 may include only one of the first and second compartment liners 20, 22 and only one of the first and second storage compartments 24, 26.

The first compartment liner 20 can comprise a main body portion 32 that defines the first storage compartment 24. The main body portion 32 has an opening 34 providing access to the first storage compartment 24. The first compartment liner 20 can further comprise a flange portion 36 that extends substantially perpendicular and outward from the main body portion 32 about the opening 34. Similarly, the second compartment liner 22 can comprise a main body portion 38 that defines the second storage compartment 26. The main body portion 38 has an opening 40 providing access to the second storage compartment 26. The second compartment liner 22 can further comprise a flange portion 42 that extends substantially perpendicular and outward from the main body portion 38 about the opening 40.

Figure 3:
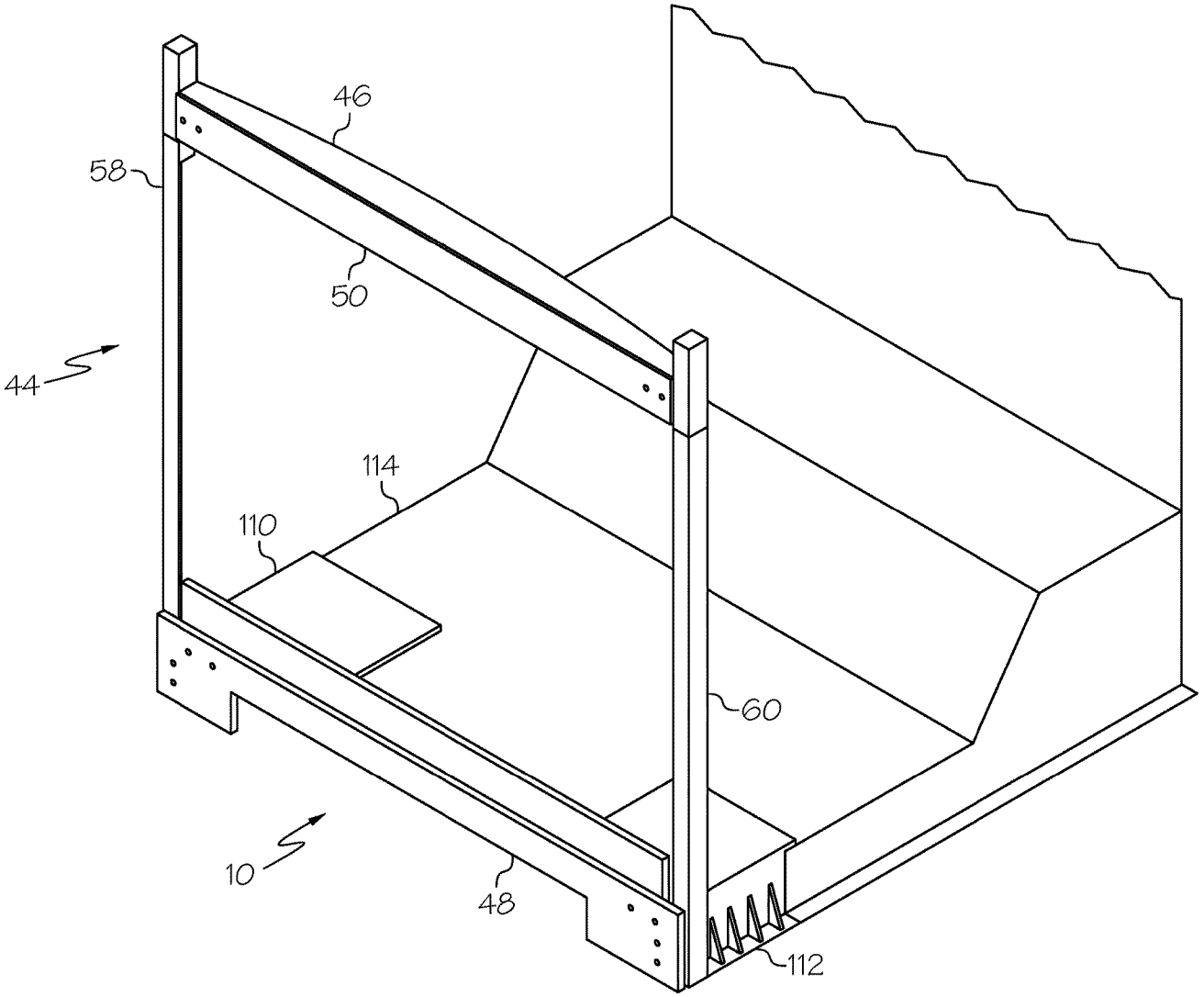
FIG. 3 is a perspective view of a rigid support structure of the example cabinet.
Figure 4:
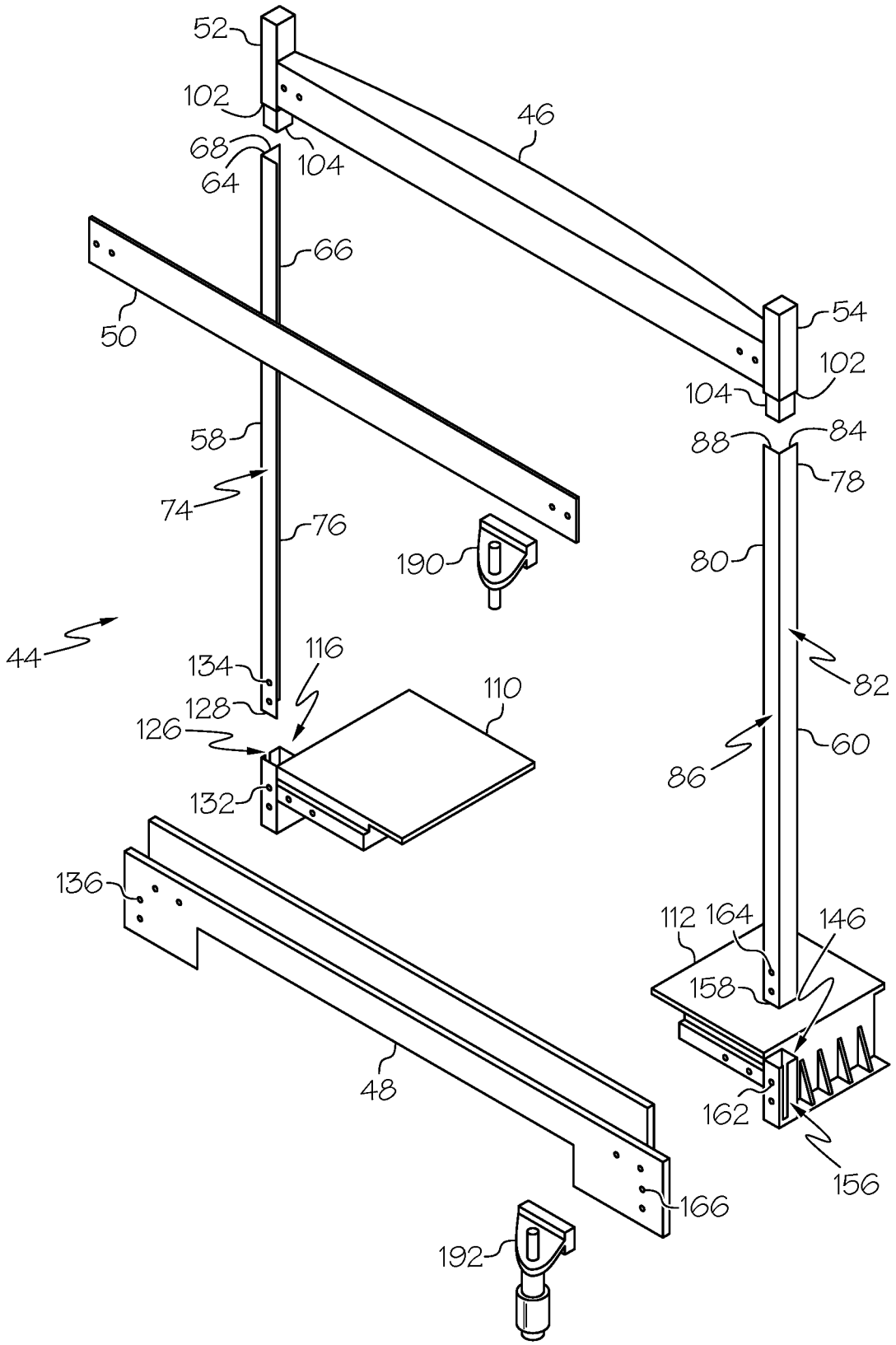
FIG. 4 is an exploded view of the rigid support structure.

Turning now to FIGS. 3 & 4, the cabinet 10 can comprise an internal, rigid support structure 44 comprising a plurality of support members secured together that can be positioned within the shell 12 to provide a support frame for the cabinet 10 and inhibit deflection, twisting, bending, or other movement of the shell 12 and the first and second compartment liners 20, 22. The rigid support structure 44 can comprise rigid upper and lower support members 46, 48 that are horizontal and longitudinally extend substantially parallel to the top wall 14. One or both of the upper and lower support members 46, 48 can be made of metal, injection molded plastic, or any other rigid material. The upper and lower support members 46, 48 in the present example are made of injection molded plastic.

The upper and lower support members 46, 48 can be provided on opposite sides of one or both of the first and second compartment liners 20, 22. For instance, in the present example, the upper and lower support members 46, 48 are provided on opposite sides of the first compartment liner 20. More specifically, the upper support member 46 is positioned above the first compartment liner 20 between the first compartment liner 20 and the second compartment liner 22. Meanwhile, the lower support member 48 is positioned below the first compartment liner 20 such that the first compartment liner 20 is between the top wall 14 and the lower support member 48. In other examples, the upper and lower support members 46, 48 may be provided on opposite sides of the second compartment liner 22 such that the upper support member 46 is positioned above the second compartment liner 22 between the second compartment liner 22 and the top wall 14 and the lower support member 48 is positioned below the second compartment liner 22 between the first compartment liner 20 and the second compartment liner 22. In still other examples, the upper and lower support members 46, 48 can be provided on opposite sides of both of the first and second compartment liners 20, 22 such that the upper support member 46 is positioned above both of the first and second compartment liners 20, 22 between the second compartment liner 22 and the top wall 14 of the shell 12 and the lower support member 48 is positioned below both of the first and second compartment liners 20, 22.

Figure 5:
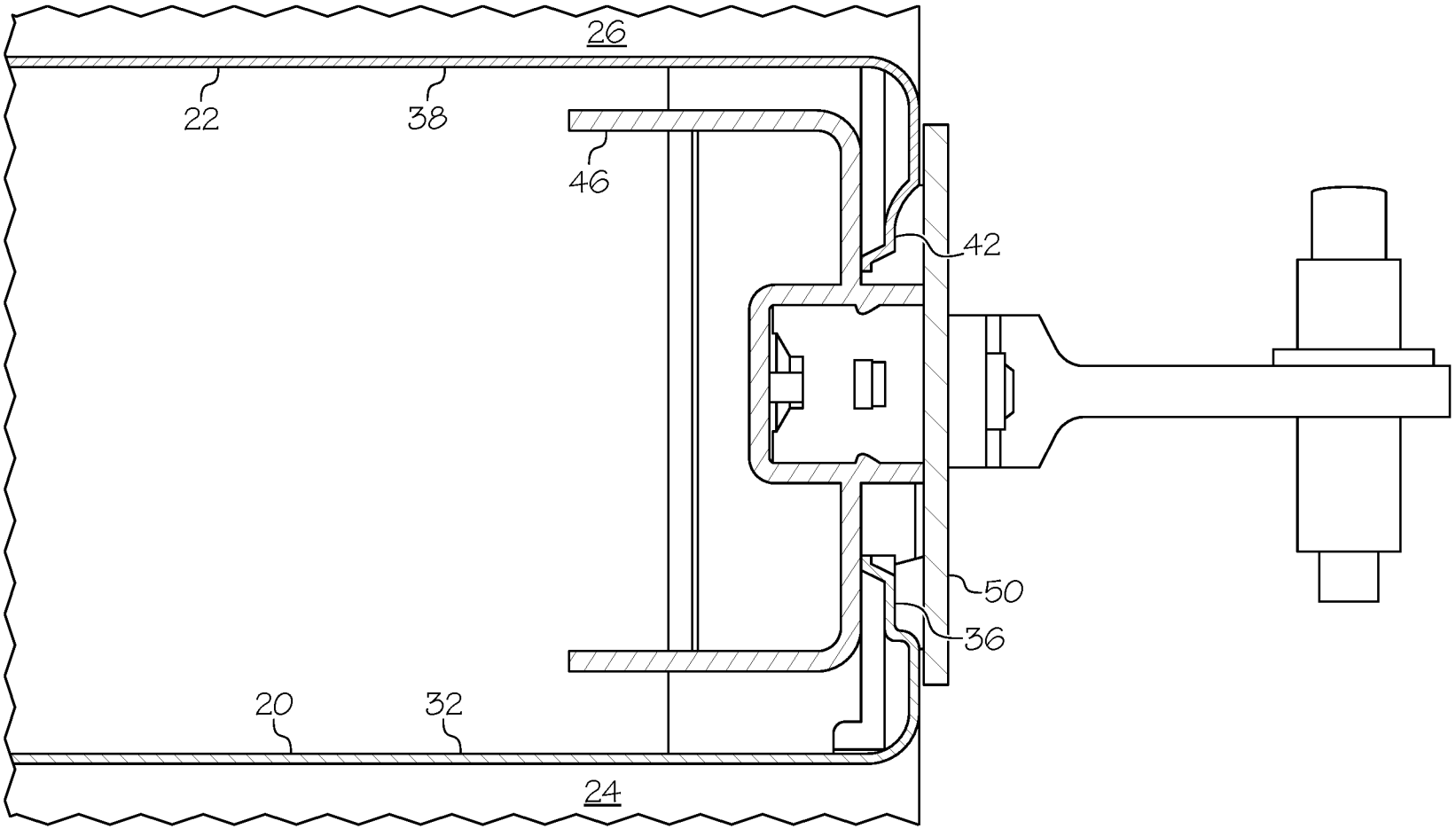
FIG. 5 is a partial cross-sectional view of the example cabinet taken along line L1-L1 in FIG. 2.

As shown in FIG. 5, the upper support member 46 can be positioned near the front, open sides of the first and second compartment liners 20, 22 and behind their respective flange portions 36, 42. Moreover, a metal face plate 50 including an anti-sweater heater can be provided in front of the upper support member 46 and the flange portions 36, 42 to conceal the upper support member 46. The upper support member 46 can be in direct contact with the first and second compartment liners 20, 22. For instance, the upper support member 46 can be in direct contact with the rear surfaces of the flange portions 36, 42, thereby providing rigid support to the first and second compartment liners 20, 22 in a back-to-front direction of the cabinet 10. However, it is to be noted that in some embodiments, the upper support member 46 may be closer to the rear sides of the first and second compartment liners 20, 22 or in front of the flange portions 36, 42.

Figure 6:
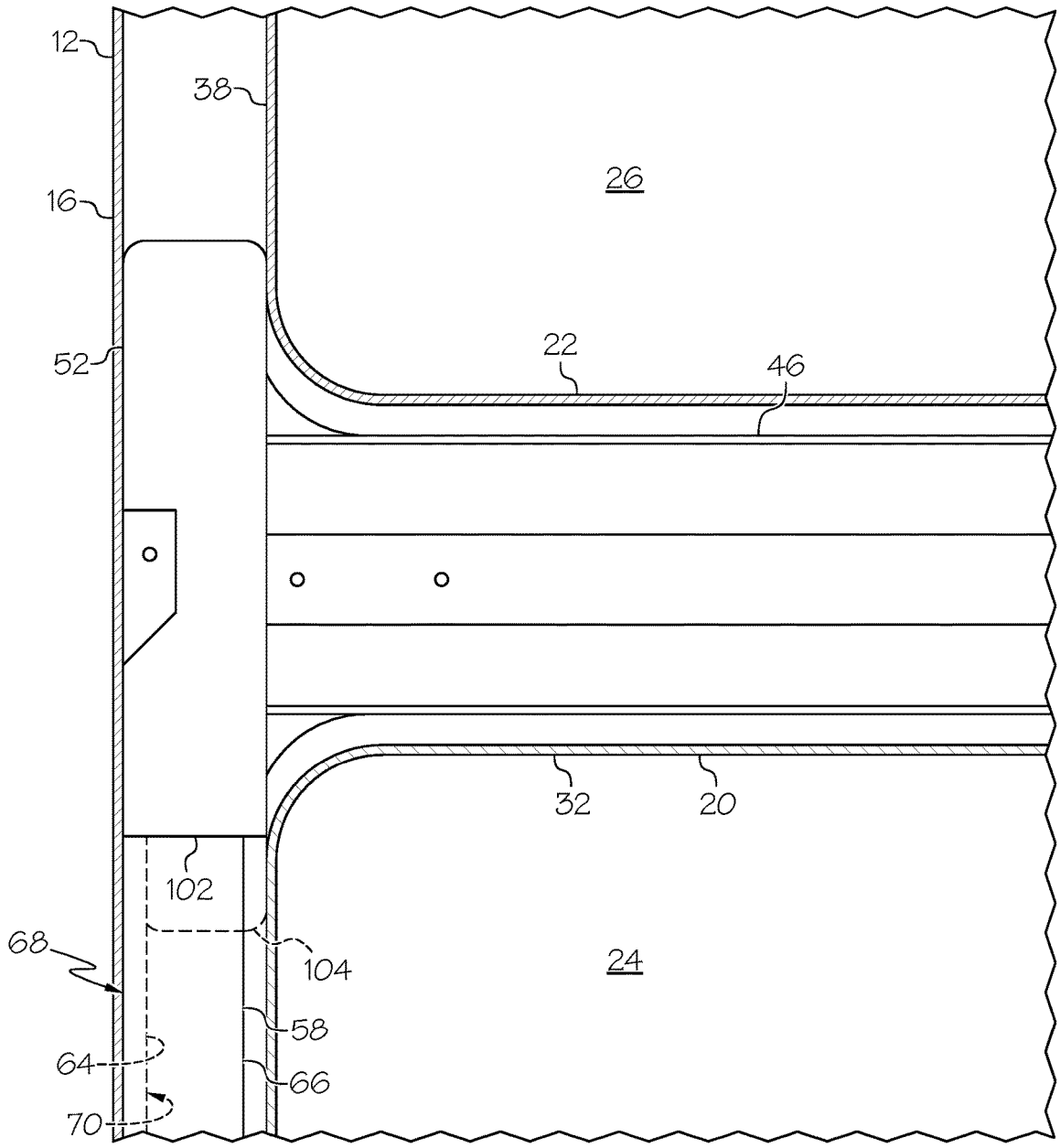
FIG. 6 is a partial cross-sectional view of a left side of the example cabinet taken along plane P in FIG. 1.
Figure 7:
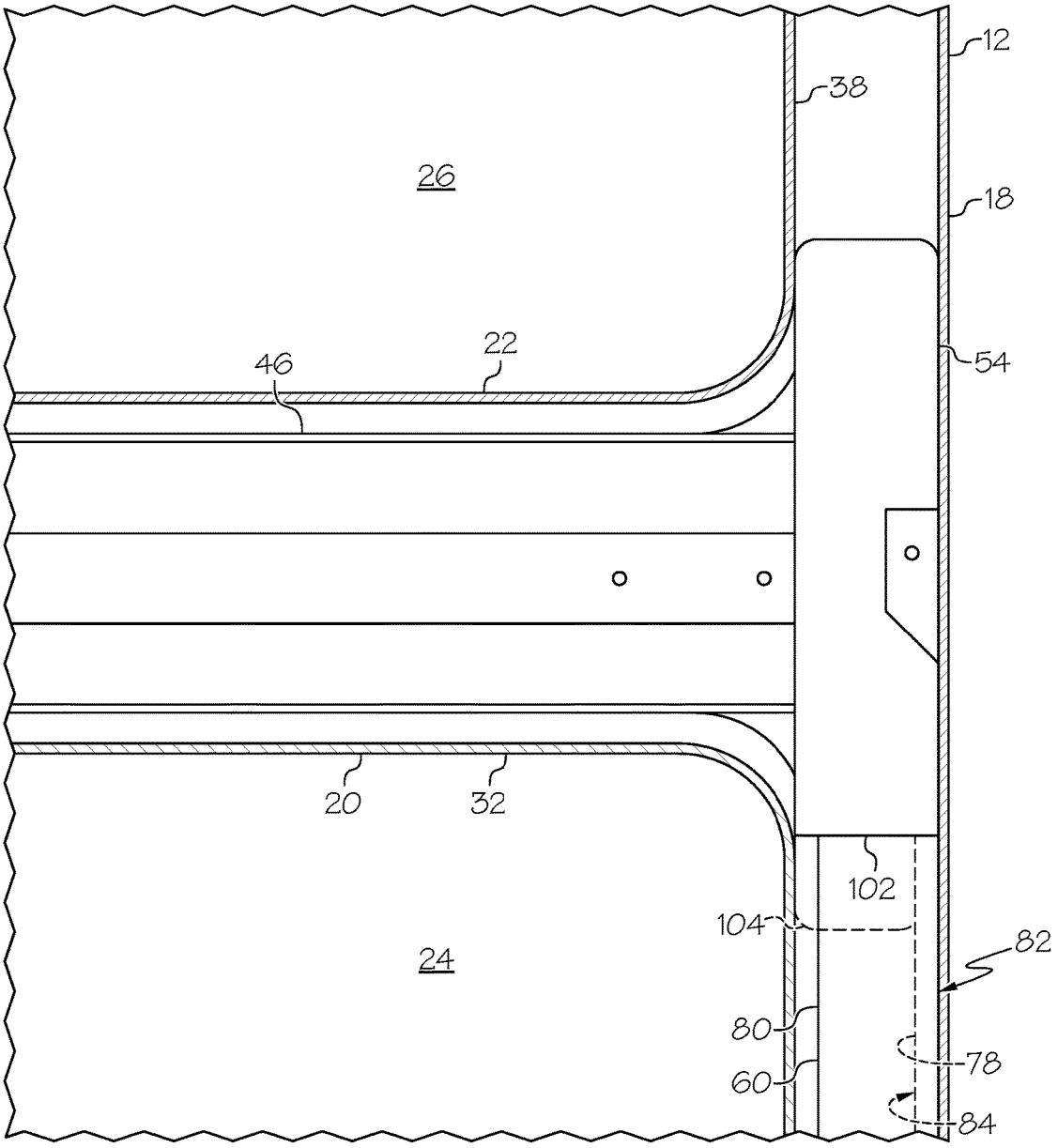
FIG. 7 is a partial cross-sectional view of a right side of the example cabinet taken along plane P in FIG. 1.

Referring now to FIGS. 6 & 7, in some embodiments, the upper support member 46 can comprise first and second end portions 52, 54 that longitudinally extend parallel to the first and second side walls 16, 18. The first end portion 52 can longitudinally extend between the first side wall 16 and the first and second compartment liners 20, 22 (as shown in FIG. 6) and the second end portion 54 can longitudinally extend between the second side wall 18 and the first and second compartment liners 20, 22 (as shown in FIG. 7). One or both of the first and second end portions 52, 54 can be in direct contact with the sides of the first compartment liner 20, thereby inhibiting lateral movement of the first compartment liner 20 between the first and/or second side walls 16, 18. Similarly, one or both of the first and second end portions 52, 54 can be in direct contact with the sides of the second compartment liner 22, thereby inhibiting lateral movement of the second compartment liner 22 between the first and/or second side walls 16, 18. However, in some examples, one or both of the first and second end portions 52, 54 can be spaced from the first compartment liner 20 and/or second compartment liner 22 such they are not in direct contact with the first compartment liner 20 and/or second compartment liner 22.

In some examples, the first end portion 52 can be in direct contact with the first side wall 16, thereby providing lateral support to the first side wall 16. Similarly, the second end portion 54 can be in direct contact with the second side wall 18, thereby providing lateral support to the second side wall 18. However, in other examples, one or both of the first and second end portions 52, 54 can be spaced from the first and second side walls 16, 18 such they are not in direct contact with the first and second side walls 16, 18.

Turning back to FIGS. 3 & 4, the rigid support structure 44 can further comprise rigid first and second vertical support bars 58, 60 that longitudinally extend substantially parallel to the first and second side walls 16, 18. The first vertical support bar 58 can longitudinally extend between the first compartment liner 20 and the first side wall 16 and the second vertical support bar 60 can longitudinally extend between the second compartment liner 22 and the second side wall 18. The first and second vertical support bars 58, 60 can be positioned near the front, open sides of the first and second compartment liners 20, 22 and behind their respective flange portions 36, 42. However, in some examples, the first and second vertical support bars 58, 60 may be closer to the rear sides of the first and second compartment liners 20, 22 or in front of the flange portions 36, 42. One or both of the first and second vertical support bars 58, 60 can be made of metal, injection molded plastic, or any other rigid material. The first and second vertical support bars 58, 60 in the present embodiments are made of angle iron.

Figure 9:
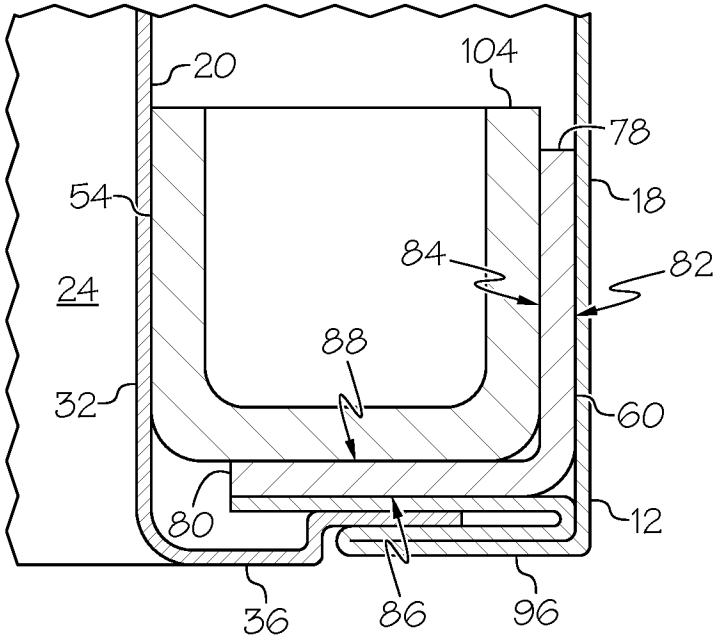
FIG. 9 is a partial cross-sectional view of a right side of the example cabinet taken along line L2-L2 in FIG. 2.
Figure 8:
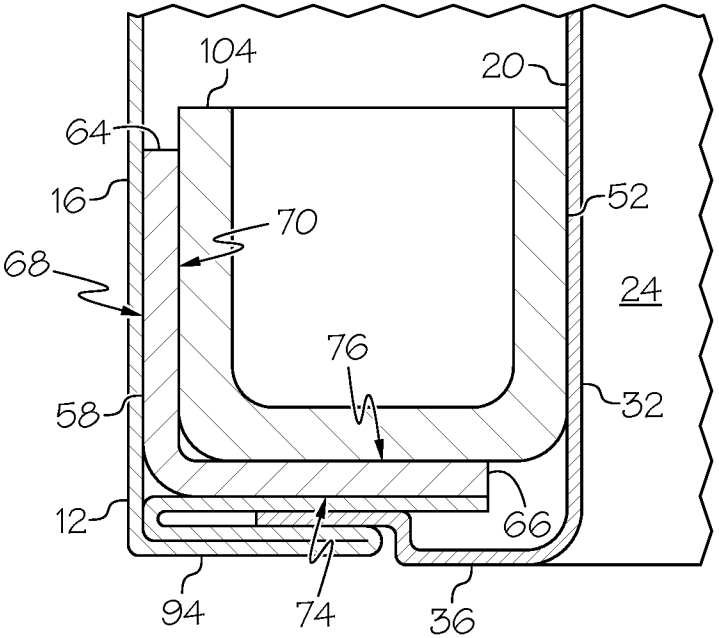
FIG. 8 is a partial cross-sectional view of a left side of the example cabinet taken along line L2-L2 in FIG. 2.

Referring now to FIGS. 8 & 9, the first and second vertical support bars 58, 60 can be configured to have an L-shaped cross-section along a plane that is substantially perpendicular to the first and second side walls 16, 18. For example, as can be seen in FIG. 8, the first vertical support bar 58 can comprise first and second members 64, 66 that longitudinally extend substantially parallel to the first and second side walls 16, 18 and are joined together along a longitudinal side thereof to form a right angle. More specifically, the first member 64 can comprise opposing major surfaces 68, 70 that extend parallel to the first and second side walls 16, 18 such that the major surface 68 faces the first side wall 16 and the major surface 70 faces the second side wall 18. Meanwhile, the second member 66 can comprise opposing major surfaces 74, 76 that extend perpendicular to the first and second side walls 16, 18 such that the major surface 74 faces the front of the cabinet 10 and the major surface 76 faces the rear of the cabinet 10. The first and second members 64, 66 are joined together along a longitudinal side thereof such that the major surfaces 68, 70 of the first member 64 respectively form right angles with the major surfaces 74, 76 of the second member 66. The first vertical support bar 58 will thus have an L-shaped cross-section along a plane that is substantially perpendicular to the first and second side walls 16, 18. When configured as such, the first vertical support bar 58 can provide rigid support in directions both parallel and perpendicular to the first and second side walls 16, 18.

As another example, the second vertical support bar 60 can comprise first and second members 78, 80 that longitudinally extend substantially parallel to the first and second side walls 16, 18 and are joined together along a longitudinal side thereof to form a right angle, as can be seen in FIG. 9. More specifically, the first member 78 can comprise opposing major surfaces 82, 84 that extend parallel to the first and second side walls 16, 18 such that the major surface 82 faces the second side wall 18 and the major surface 84 faces the first side wall 16. Meanwhile, the second member 80 can comprise opposing major surfaces 86, 88 that extend perpendicular to the first and second side walls 16, 18 such that the major surface 86 faces the front of the cabinet 10 and the major surface 88 faces the rear of the cabinet 10. The first and second members 78, 80 are joined together along a longitudinal side thereof such that the major surfaces 82, 84 of the first member 78 respectively form right angles with the major surfaces 86, 88 of the second member 80. The second vertical support bar 60 will thus have an L-shaped cross-section along a plane that is substantially perpendicular to the first and second side walls 16, 18. When configured as such, the second vertical support bar 60 can provide rigid support in directions both parallel and perpendicular to the first and second side walls 16, 18.

It is to be appreciated that although the first and second vertical support bars 58, 60 in the illustrated embodiment have a cross-section shaped as an L, the first and second vertical support bars 58, 60 can have other shaped cross-sections that include an L-shape as part of their overall shaped cross-section. For instance, in some examples, the first and/or second vertical support bars 58, 60 can have a T-shaped or U-shaped cross-section that includes an L-shape as part of the overall shaped cross-section.

In some embodiments, the first vertical support bar 58 can be in direct contact with the first side wall 16, thereby providing rigid, lateral support for the first side wall 16. For example, the major surface 68 of the first vertical support bar 58 may be in direct with the first side wall 16. Similarly, the second vertical support bar 60 can be in direct contact with the second side wall 18, thereby providing rigid, lateral support for the second side wall 18. For example, the major surface 82 of the second vertical support bar 60 may be in direct with the second side wall 18. However, in some embodiments, the first and/or second vertical support bars 58, 60 may be spaced from the first and second side walls 16, 18 such that they are not in direct contact with the first and second side walls 16, 18.

In some examples, the shell 12 can comprise a first side flange portion 94 that extends substantially perpendicular from the first side wall 16 towards the second side wall 18 and the first vertical support bar 58 can be in direct contact with the first side flange portion 94, thereby providing rigid support for the first side flange portion 94 in the back-to-front direction of the cabinet 10. For instance, the major surface 74 of the first vertical support bar 58 may be in direct with the first side flange portion 94. Similarly, in some examples, the shell 12 can comprise a second side flange portion 96 that extends substantially perpendicular from the second side wall 18 towards the first side wall 16 and the second vertical support bar 60 can be in direct contact with the second side flange portion 96, thereby providing rigid support for the second side flange portion 96 in the back-to-front direction of the cabinet 10. For instance, the major surface 86 of the second vertical support bar 60 may be in direct with the second side flange portion 96. However, in some examples, the first and/or second vertical support bars 58, 60 may be spaced from the first and second side flange portions 94, 96 such that they are not in direct contact with the first and second side flange portions 94, 96.

The first and second vertical support bars 58, 60 can be secured to the upper support member 46. For example, the first and second vertical support bars 58, 60 can be secured to the first and second end portions 52, 54 of the upper support member 46 using threaded fasteners, clips, welds, adhesive, or other fastening means known in the art. As another example, the first and second end portions 52, 54 can of the upper support member 46 can be secured to the first and second vertical support bars 58, 60 by gravity with a foam that holds the upper support member 46 first and second vertical support bars 58, 60. For instance, the first and second end portions 52, 54 each comprise a shoulder 102 configured such that the first end portion 52 of the upper support member 46 can rest upon the first vertical support bar 58 and the second end portion 54 of the upper support member 46 can rest upon the second vertical support bar 60, as shown in FIGS. 6 & 7. Moreover, the first and second end portions 52, 54 can each comprise a projection 104 that extends downward from the shoulder 102 and engages the first and second vertical support bars 58, 60 to help position the upper support member 46 on the first and second vertical support bars 58, 60. The projection 104 of the first end portion 52 can engage the major surfaces 70, 76 of the first vertical support bar 58 and the projection 104 of the second end portion 54 can engage the major surfaces 84, 88 of the second vertical support bar 60, as shown in FIGS. 8 & 9. While the upper support member 46 is resting on the first and second vertical support bars 58, 60 as such, a foam can be provided within the shell 12 to fill gaps in the shell 12 around the first and second vertical support bars 58, 60 and hold the first and second vertical support bars 58, 60 against the upper support member 46, thereby securing the first and second vertical support bars 58, 60 thereto. The foam can be an insulating foam typically used within shells of refrigerator appliances or any other foam that can be applied to fill gaps in the shell 12 around the first and second vertical support bars 58, 60 and hold the first and second vertical support bars 58, 60 against the upper support member 46. When the first vertical support bars 58, 60 are secured to the upper support member 46 in this manner, it is unnecessary to use extra parts such as threaded fasteners to secure the first vertical support bars 58, 60 to the upper support member 46. Accordingly, the material and assembly costs of the cabinet 10 can be reduced.

Figure 10:
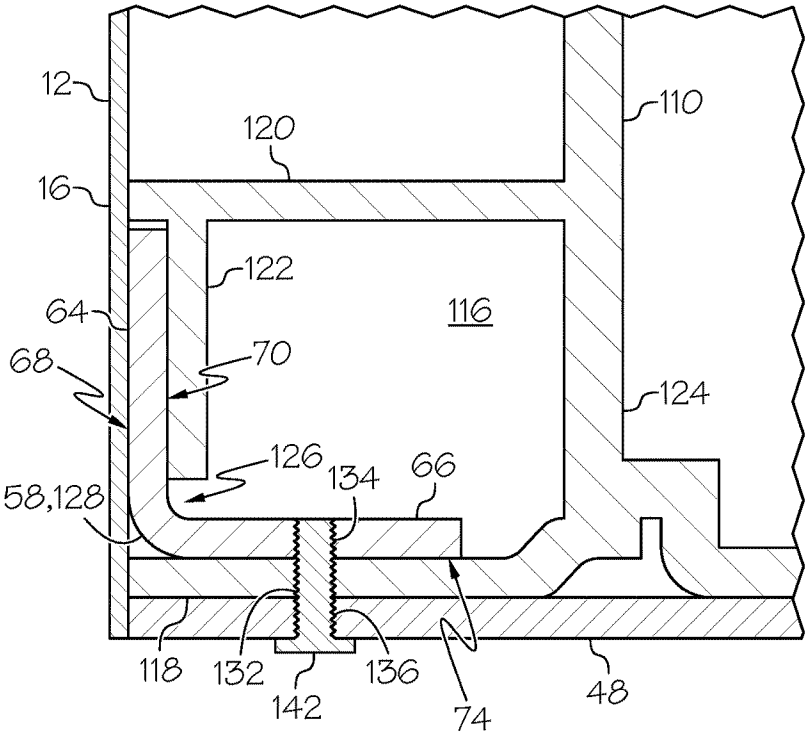
FIG. 10 is a partial cross-sectional view of a left side of the example cabinet taken along line L3-L3 in FIG. 2.

In some embodiments, the rigid support structure 44 can further comprise a first base member 110 and a second base member 112 positioned below the first and second compartment liners 20, 22 configured to support the cabinet 10, as can be seen in FIGS. 3 & 4. Each of the first and second base members 110, 112 can be mounted to a base portion 114 of the cabinet 10 and in some embodiments can comprise a foot member such as a roller wheel, a post, or any other structure that the cabinet 10 can rest upon when upright. Each of the first and second base members 110, 112 can further comprise structure for securing the lower support member 48 and one of the first and second vertical support bars 58, 60 thereto. For example, the first base member 110 can comprise a vertical channel 116 defined by a front wall 118, a rear wall 120, and a pair of side walls 122, 124, as can be seen in FIG. 4 and more closely, in FIG. 10. The first base member 110 can further comprise a vertical opening 126 between the front wall 118 and the side wall 122. An end portion 128 of the first vertical support bar 58 can be received either partially or completely within the vertical channel 116. For instance, the end portion 128 of the first vertical support bar 58 can be received partially within the vertical channel 116 such that the major surface 74 of the vertical support's second member 66 will be in direct contact with an interior surface of the front wall 118. Meanwhile, the end portion 128 can extend through the vertical opening 126 such that part of the end portion 128 is located outside of the vertical channel 116 and more specifically, the major surface 70 of the vertical support's first member 64 will be in direct contact with an exterior surface of the side wall 122. The major surface 74 of the first vertical support bar 58 can be flush with and substantially parallel to the interior surface of the front wall 118. Meanwhile, the major surface 70 of the first vertical support bar 58 can be flush with and substantially parallel to the exterior surface of the side wall 122. When positioned within the vertical channel 116 as such, the first vertical support bar 58 can be supported by the first base member 110 along axes parallel and perpendicular to the first and second side walls 16, 18. However, it is to be noted that the first vertical support bar 58 may be alternatively arranged relative to the vertical channel 116 in other embodiments.

The first base member 110 can further comprise one or more apertures that can align with one or more apertures of the first vertical support bar 58 when the first vertical support bar 58 is received within the vertical channel 116. For instance, the first base member 110 can comprise one or more apertures 132 extending through its front wall 118 that align with one or more apertures 134 extending through the second member 66 of the first vertical support bar 58 when the first vertical support bar 58 is received within its vertical channel 116, though the apertures 132, 134 may extend through other portions of the first base member 110 and the first vertical support bar 58 in other embodiments. The lower support member 48 can also comprise one or more apertures 136 that can be aligned with the apertures 132, 134 of the first vertical support bar 58 and the first base member 110. When aligned as such, a rear surface of the lower support member 48 will be flush with and substantially parallel to an exterior surface of the front wall 118. Once all the apertures 132, 134, 136 are aligned, a threaded fastener 142 may be inserted through the corresponding apertures 132, 134, 136 to threadably secure the first vertical support bar 58, the first base member 110 and the lower support member 48 to each other. The threaded fastener 142 can threadably engage one or more of the corresponding apertures 132, 134, 136 or a nut may be provided on the threaded fastener 142 to threadably secure the first vertical support bar 58, the first base member 110 and the lower support member 48 to each other. By inserting the threaded fastener 142 through the corresponding apertures 132, 134, 136 in this manner, the first vertical support bar 58, the first base member 110 and the lower support member 48 can be secured to each other with only one or two threaded fasteners, thereby reducing material and assembly costs.

In addition or in alternative to securing the first vertical support bar 58, first base member 110 and lower support member 48 to each other with the threaded fastener 142, a foam can be provided within the shell 12 to fill gaps in the shell 12 around the first vertical support bar 58, the first base member 110 and the lower support member 48 and hold the first vertical support bar 58 and the lower support member 48 against the first base member 110, thereby additionally or alternatively securing the first vertical support bar 58, first base member 110 and lower support member 48 to each other. The foam can be an insulating foam typically used within shells of refrigerator appliances or any other foam that can be applied to fill gaps in the shell 12 around the first vertical support bar 58, the first base member 110 and the lower support member 48.

Figure 11:
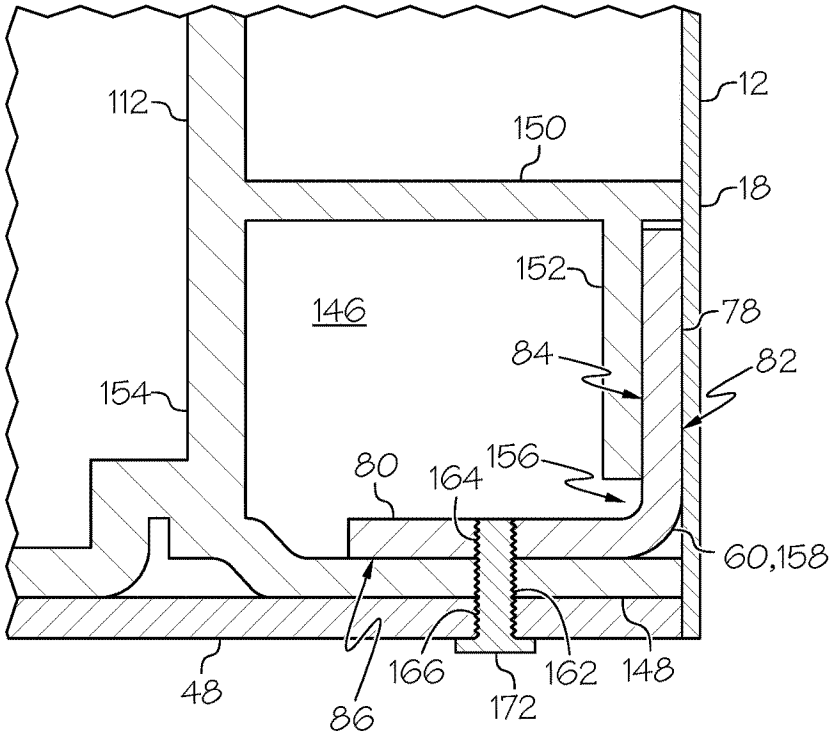
FIG. 11 is a partial cross-sectional view of a right side of the example cabinet taken along line L3-L3 in FIG. 2.

The second base member 112 can similarly comprise a vertical channel 146 defined by a front wall 148, a rear wall 150, and a pair of side walls 152, 154, as can be seen in FIG. 4 and more closely, in FIG. 11. The second base member 112 can further comprise a vertical opening 156 between the front wall 148 and the side wall 152. An end portion 158 of the second vertical support bar 60 can be received either partially or completely within the vertical channel 146. For instance, the end portion 158 of the second vertical support bar 60 can be received partially within the vertical channel 146 such that the major surface 86 of the vertical support's second member 80 will be in direct contact with an interior surface of the front wall 148. Meanwhile, the end portion 158 can extend through the vertical opening 156 such that part of the end portion 158 is located outside of the vertical channel 146 and more specifically, the major surface 84 of the vertical support's first member 78 will be in direct contact with an exterior surface of the side wall 152. The major surface 86 of the first vertical support bar 58 can be flush with and substantially parallel to the interior surface of the front wall 148. Meanwhile, the major surface 84 of the first vertical support bar 58 can be flush with and substantially parallel to the exterior surface of the side wall 152. When positioned within the vertical channel 146 as such, the second vertical support bar 60 can be supported by the second base member 112 along axes parallel and perpendicular to the first and second side walls 16, 18. However, it is to be noted that the second vertical support bar 60 may be alternatively arranged relative to the vertical channel 146 in other embodiments.

The second base member 112 can further comprise one or more apertures that can align with one or more apertures of the second vertical support bar 60 when the second vertical support bar 60 is received within the vertical channel 146. For instance, the second base member 112 can comprise one or more apertures 162 extending through its front wall 148 that align with one or more apertures 164 extending through the second member 80 of the second vertical support bar 60 when the second vertical support bar 60 is received within its vertical channel 146, though the apertures 162, 164 may extend through other portions of the second base member 112 and the second vertical support bar 60 in other embodiments. The lower support member 48 can also comprise one or more apertures 166 that can be aligned with the apertures 162, 164 of the second vertical support bar 60 and the second base member 112. When aligned as such, a rear surface of the lower support member 48 will be flush with and substantially parallel to an exterior surface of the front wall 148. Once all the apertures 162, 164, 166 are aligned, a threaded fastener 172 may be inserted through the corresponding apertures 162, 164, 166 to threadably secure the second vertical support bar 60, the second base member 112 and the lower support member 48 to each other. The threaded fastener 172 can threadably engage one or more of the corresponding apertures 162, 164, 166 or a nut may be provided on the threaded fastener 172 to threadably secure the second vertical support bar 60, the second base member 112 and the lower support member 48 to each other. By inserting the threaded fastener 172 through the corresponding apertures 162, 164, 166 in this manner, the second vertical support bar 60, the second base member 112 and the lower support member 48 can be secured to each other with only one or two threaded fasteners, thereby reducing material and assembly costs.

In addition or in alternative to securing the second vertical support bar 60, second base member 112 and lower support member 48 to each other with the threaded fastener 172, a foam can be provided within the shell 12 to fill gaps in the shell 12 around the second vertical support bar 60, second base member 112 and lower support member 48 and hold the second vertical support bar 60 and lower support member 48 against the second base member 112, thereby additionally or alternatively securing the second vertical support bar 60, second base member 112 and lower support member 48 to each other. The foam can be an insulating foam typically used within shells of refrigerator appliances or any other foam that can be applied to fill gaps in the shell 12 around the second vertical support bar 60, second base member 112 and lower support member 48.

Figure 12:
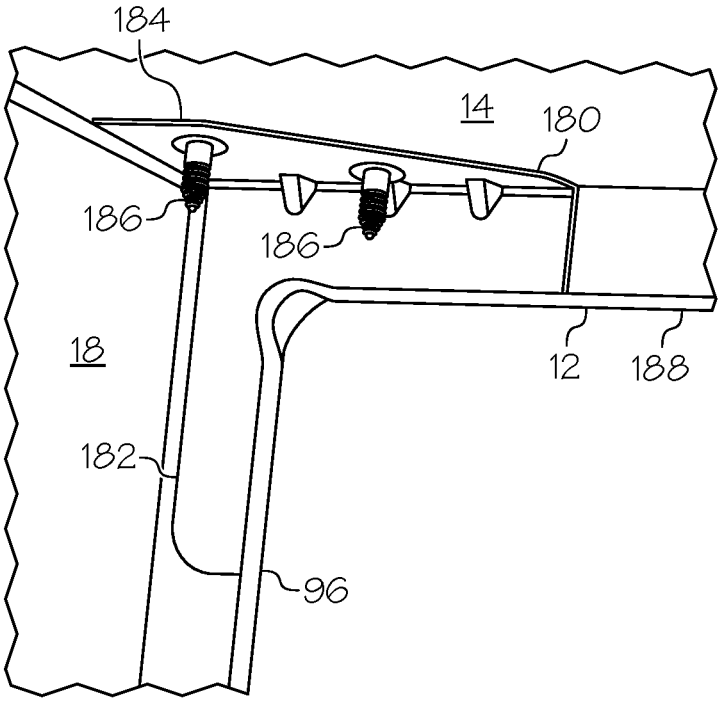
FIG. 12 is a perspective view of a tapping plate of the example refrigerator according to one configuration.
Figure 13:
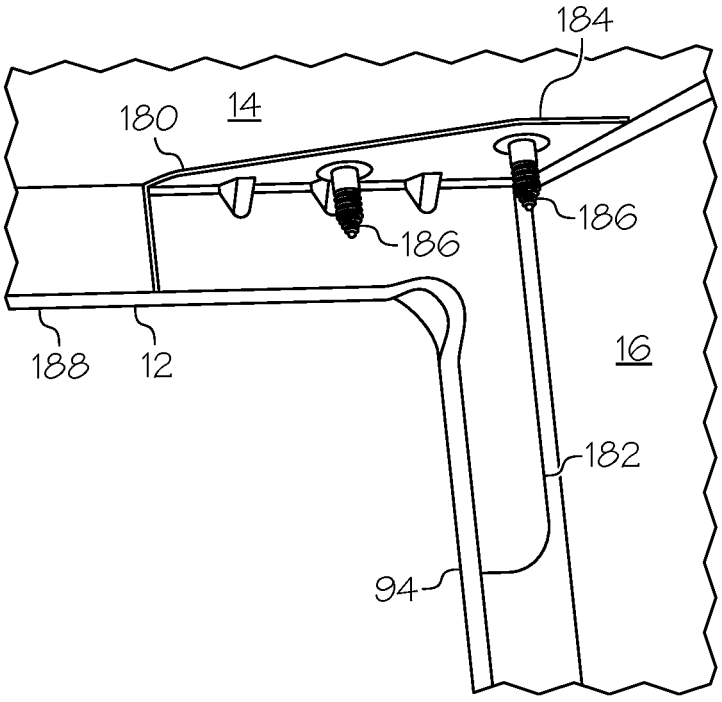
FIG. 13 is a perspective view of a tapping plate of the example refrigerator according to another configuration.

Turning now to FIGS. 12 & 13, in some embodiments the rigid support structure 44 can further comprise a rigid tapping plate 180 that is secured to one or more interior surfaces of the shell 12. The tapping plate 180 can be made of metal, injection molded plastic, or any other rigid material. The tapping plate 180 can comprise a first member 182 and a second member 184 that are joined to form a right angle. Moreover, the tapping plate 180 can comprise one or more threaded receiving portions 186 that can receive threaded fasteners used in mounting hinge assemblies for a door of the cabinet 10. The receiving portions 186 may be extruded members that extend from one or both of the first and second members 182, 184 or the receiving portions 186 may be threaded apertures that extend through one or both of the first and second members 182, 184.

In some examples, the tapping plate 180 can be arranged within an interior corner of the shell 12, slightly spaced from the second side wall 18 such that the first member 182 is in direct contact with an interior surface of the second side flange portion 96 as well an interior surface of a top flange portion 188 that extends substantially perpendicular to and inward from the top wall 14, as shown in FIG. 12. Furthermore, the tapping plate 180 can be arranged such that the second member 184 is in direct contact with an interior surface of the top wall 14. When arranged as such, the tapping plate 180 can provide rigid support for the second side flange portion 96, the top flange portion 188, and the top wall 14.

In other examples, the tapping plate 180 can be arranged within an opposite interior corner of the shell 12, slightly spaced from the first side wall 16 such that the first member 182 is in direct contact with an interior surface of the first side flange portion 94 and an interior surface of the top flange portion 188, as shown in FIG. 13. Furthermore, the tapping plate 180 can be arranged such that the second member 184 is in direct contact with an interior surface of the top wall 14. When arranged as such, the tapping plate 180 can provide rigid support for the first side flange portion 94, the top flange portion 188, and the top wall 14.

A foam can be provided within the shell 12 to fill gaps in the shell 12 around the tapping plate 180 and hold the tapping plate 180 against the shell 12, thereby securing the tapping plate 180 thereto. However, the tapping plate 180 may be secured to the shell 12 in other embodiments using other means such as fasteners, clips, adhesives, or other means known in the art.

The rigid support structure 44 described above can provide a support frame for the cabinet 10 that inhibits movement of the shell 12 and the first and second compartment liners 20, 22. Moreover, in some embodiments, various mounting structure for the doors of the cabinet 10 can be attached to the rigid support structure 44. For example, as mentioned above, a mounting assembly can be mounted using threaded fasteners that thread into the threaded receiving portions 186 of the tapping plate 180. The mounting assembly may be a hinge for one of the doors of the cabinet 10 such as, for example, the upper door 30. As another example, the cabinet 10 can comprise an upper hinge member 190 that is attached to the upper support member 46 and a lower hinge member 192 that is attached to the lower support member 48, as shown in FIG. 4. The upper and lower hinge members 190, 192 can movably couple the lower door 28 to the upper and support members 46, 48, respectively. Moreover, the upper hinge member 190 can movably couple the upper door 30 to the upper support member 46.

A number of examples have been described above. Nevertheless, it will be understood that various modifications may be made. For example, suitable results may be achieved if the described elements are combined in a different manner and/or replaced or supplemented by other elements or their equivalents.

What is claimed is:

1. A cabinet comprising:

a shell having a top wall and first and second side walls extending substantially perpendicular from the top wall;

a first compartment liner provided within the shell, the first compartment liner defining a first storage compartment;

an upper support member and lower support member provided on opposite sides of the first compartment liner, the upper and lower support members extending substantially parallel to the top wall;

a first vertical support bar secured to the upper and lower support members, the first vertical support bar extending substantially parallel to the first and second side walls and between the first compartment liner and the first side wall; and a second vertical support bar secured to the upper and lower support members, the second vertical support bar extending substantially parallel to the first and second side walls and between the first compartment liner and the second side wall, wherein the first and second vertical support bars have an L-shaped cross-section along a plane that is substantially perpendicular to the first and second side walls, further comprising a second compartment liner provided within the shell, the second compartment liner defining a second storage compartment, wherein the upper support member extends between the first compartment liner and the second compartment liner, wherein the upper support member comprises first and second end portions that extend parallel to the first and second side walls, further wherein the first end portion extends between the first side wall and the first and second compartment liners and the second end portion extends between the second side wall and the first and second compartment liners, wherein the first and second end portions of the upper support member are in direct contact with the first compartment liner and the second compartment liner, and wherein the first end portion of the upper support member is in direct contact with the first side wall and the second end portion of the upper support member is in direct contact with the second side wall.

2. The cabinet of claim 1, wherein the first vertical support bar comprises first and second members that longitudinally extend substantially parallel to the first and second side walls and are joined together along a longitudinal side thereof to form a right angle.

3. The cabinet of claim 1, wherein the first vertical support bar is in direct contact with the first side wall and the second vertical support bar is in direct contact with the second side wall.

4. The cabinet of claim 1, wherein the shell comprises a first side flange portion that extends substantially perpendicular from the first side wall and a second side flange portion that extends substantially perpendicular from the second side wall, further wherein the first vertical support bar is in direct contact with the first side flange portion and the second vertical support bar is in direct contact with the second side flange portion.

5. The cabinet of claim 1, wherein said first and second end portions of the upper support member each comprise a shoulder, further wherein the shoulder of the first end portion rests upon the first vertical support bar and the shoulder of the second end portion rests upon the second vertical support bar.

6. The cabinet of claim 1, wherein the first and second vertical support bars are secured to the upper support member with a foam that holds the first and second vertical support bars against the upper support member.

7. The cabinet of claim 1, further comprising a first base member and a second base member positioned below the first compartment liner, the first base member comprising a first vertical channel for receiving the first vertical support bar and the second base member comprising a second vertical channel for receiving the second vertical support bar.

8. The cabinet of claim 7, wherein the first vertical channel is defined by a front wall of the first base member and a side wall of the first base member, further wherein the first base member comprises a vertical opening between the front wall of the first base member and the side wall of the first base member.

9. The cabinet of claim 1, further comprising a tapping plate, wherein the tapping plate is in direct contact with the top wall, a top flange portion extending substantially perpendicular from the top wall, and a side flange portion extending substantially perpendicular from one of the first and second side walls.

10. The cabinet of claim 9, wherein the tapping plate is secured to the shell with a foam that holds the tapping plate against the shell.

11. The cabinet of claim 9, wherein the tapping plate is spaced from one of the first and second side walls.

12. The cabinet of claim 1, further comprising a door and upper and lower hinge members, the upper hinge member being attached to the upper support member and movably coupling the door to the upper support member, the lower hinge member being attached to the lower support member and movably coupling the door to the lower support member.

13. A cabinet comprising:

a shell having a top wall and first and second side walls extending substantially perpendicular from the top wall;

a first compartment liner provided within the shell, the first compartment liner defining a first storage compartment;

an upper support member and lower support member provided on opposite sides of the first compartment liner, the upper and lower support members extending substantially parallel to the top wall;

a first vertical support bar secured to the upper and lower support members, the first vertical support bar extending substantially parallel to the first and second side walls and between the first compartment liner and the first side wall; and a second vertical support bar secured to the upper and lower support members, the second vertical support bar extending substantially parallel to the first and second side walls and between the first compartment liner and the second side wall, wherein the first and second vertical support bars have an L-shaped cross-section along a plane that is substantially perpendicular to the first and second side walls, further comprising a first base member and a second base member positioned below the first compartment liner, the first base member comprising a first vertical channel for receiving the first vertical support bar and the second base member comprising a second vertical channel for receiving the second vertical support bar, and wherein the first vertical channel is defined by a front wall of the first base member and a side wall of the first base member, further wherein the first base member comprises a vertical opening between the front wall of the first base member and the side wall of the first base member; wherein the first vertical support bar is received within the first vertical channel such that the first vertical support bar is in direct contact with an interior surface of the front wall of the first base member and an exterior surface of the side wall of the first base member, further wherein the first vertical support bar extends through the vertical opening.

14. The cabinet of claim 13, wherein the first base member further comprises one or more apertures aligned with one or more apertures of the first vertical support bar.

* * * * *